US009060557B2

(12) United States Patent
Maier

(10) Patent No.: US 9,060,557 B2
(45) Date of Patent: Jun. 23, 2015

(54) SAFETY HELMET, IN PARTICULAR FOR CYCLISTS

(71) Applicant: Marzell Wilhelm Maier, Sommersbach (DE)

(72) Inventor: Marzell Wilhelm Maier, Sommersbach (DE)

( * ) Notice: Subject to any disclaimer, the term of this patent is extended or adjusted under 35 U.S.C. 154(b) by 0 days.

(21) Appl. No.: 14/360,031

(22) PCT Filed: Dec. 24, 2012

(86) PCT No.: PCT/EP2012/005380
§ 371 (c)(1),
(2) Date: May 22, 2014

(87) PCT Pub. No.: WO2013/097943
PCT Pub. Date: Jul. 4, 2013

(65) Prior Publication Data

US 2014/0338105 A1 Nov. 20, 2014

(30) Foreign Application Priority Data

Dec. 31, 2011 (DE) ..... 10 2011 122 796

(51) Int. Cl.
*A42B 3/04* (2006.01)
*A42B 3/32* (2006.01)
*A42B 3/08* (2006.01)

(52) U.S. Cl.
CPC . *A42B 3/04* (2013.01); *A42B 3/326* (2013.01); *A42B 3/08* (2013.01)

(58) Field of Classification Search
CPC ..... A42B 3/08
USPC ..... 2/421, 410, 424, 425, 9, 10, 415, 468
See application file for complete search history.

(56) References Cited

U.S. PATENT DOCUMENTS

| | | | | |
|---|---|---|---|---|
| 4,024,587 | A | 5/1977 | Barford | |
| 4,290,150 | A * | 9/1981 | Guerre-Berthelot | 2/421 |
| 4,587,676 | A * | 5/1986 | Estadella | 2/424 |
| 5,129,108 | A * | 7/1992 | Copeland et al. | 2/424 |
| 5,421,035 | A | 6/1995 | Klose et al. | |
| 5,517,698 | A | 5/1996 | Nault et al. | |
| 5,621,923 | A | 4/1997 | Tapocik | |
| 6,009,562 | A | 1/2000 | Bullock et al. | |
| 8,321,965 | B2 * | 12/2012 | Newman | 2/421 |

FOREIGN PATENT DOCUMENTS

| | | |
|---|---|---|
| DE | 3025770 A1 | 2/1982 |
| DE | 3214020 A1 | 7/1983 |
| DE | 4322339 A1 | 1/1995 |

OTHER PUBLICATIONS

International Search Report of PCT/EP2012/005380, mailed Apr. 11, 2013.
Written Opinion of the International Searching Authority of PCT/EP2012/005380, Apr. 11, 2013.

* cited by examiner

*Primary Examiner* — Tejash Patel
(74) *Attorney, Agent, or Firm* — Collard & Roe, P.C.

(57) ABSTRACT

A safety helmet, in particular for cyclists, includes a self-contained portable semi-shell helmet (H), on which an integral part (1) enclosing the chin and the occiput/neck area can be fixed in a detachable way. The semi-shell helmet (H) is equipped as a self-contained helmet with a chin strap fastening and all that belongs to known helmets, This hence enables, depending on the intended use, only to wear the upper helmet part or the assembled integral helmet.

7 Claims, 3 Drawing Sheets

SAFETY HELMET, IN PARTICULAR FOR CYCLISTS

CROSS REFERENCE TO RELATED APPLICATIONS

Figure 1:
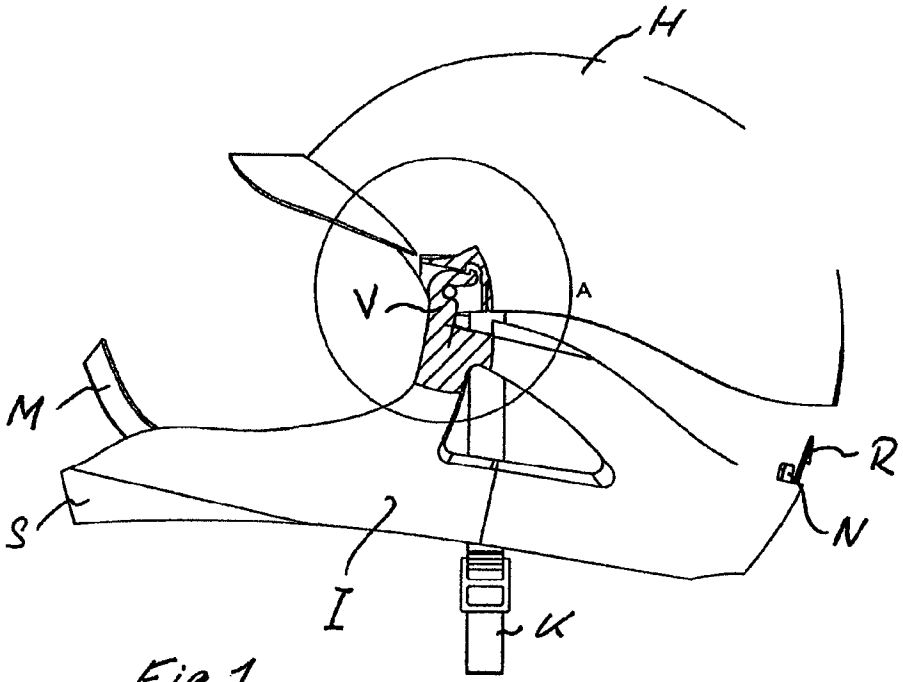

This application is the National Stage of PCT/EP2012/005380 filed on Dec. 24, 2012, which claims priority under 35 U.S.C. §119 of German Application No. 10 2011 122 796.6 filed on Dec. 31, 2011, the disclosure of which is incorporated by reference. The international application under PCT article 21(2) was published in English.

The invention concerns a safety helmet, in particular for cyclists. Known safety helmets generally consist of an helmet shell and of a carrying system, in particular an adjustable carrying system, arranged inside the helmet shell. They are predominantly made of plastic. They should protect the wearer against possible damages and injuries.

The protective effect consists in particular in absorbing shocks when falling off the bike. The helmets consist of a rugged external helmet shell. In particular for protecting against impacts but also for improving wearing comfort, many helmets have absorbing linings, for instance made of moulded foam plastic in the inside. An adjustable chin strap holds the helmet on the head of the person wearing the helmet, with most embodiments of the safety helmets.

So-called integral helmets are used for demanding sports contexts as they are known from motorbike helmets. They are characterised in that they enclose and protect via a so-called chin part the lower jaw respectively the whole area around the mouth. Such integral helmets, which are designed at least as a single piece, still offer good protection for their field of application, but prove sudorific and uncomfortable when riding uphill since they enclose the head completely.

A helmet, including a chinguard is disclosed in the German Patent Application DE 4322339 A1. In such a helmet, which consists among others of two side portions, said portions can be connected to one another by a chinguard. The shortcoming is here that the chinguard does not enclose the whole occiput and consequently does not contribute optimally to holding the whole helmet safely.

The German Patent Application DE 3214020 A1 discloses a safety helmet, whose shell consists of an upper part and a separate lower part, which is connected to said upper part, where both parts of the safety helmet can be connected to one another in a detachable way. The detachable connections hence consist of locking tongues, which mesh with retaining pockets formed in the lower part and there can be locked and unlocked by means of an eccentric under elastic deformation. The eccentric is hence designed in such a way that it must be operated as a consequence by means of a tool (of a screwdriver or of a coin, etc.). The shortcoming of said safety helmet lies in that several steps are required for fastening the helmet parts. First of all, the helmet parts should be assembled in such a way that the locking tongues mesh into retaining pockets designed to that end and subsequently all present eccentrics should be brought into the latching position with the tool provided to that effect. This helmet can be used either as an integral helmet, a cross helmet or a jet helmet. Indeed, the respective corresponding lower part must accordingly be mounted to the upper part. The upper part of the helmets cannot be worn as a separate helmet.

A further safety helmet is disclosed in the German Patent Application DE 3025770 A1. The outer shell of said helmet consists of at least two partial shells which are connected to one another in a detachable way, whereas the partial shells are connected to one another via a circumferential tear-off fastener. Locking journals are then provided on a circumferential loose band, said journals mesh into recess so as to fix both parts together and hence to form a complete helmet. The tear-off fastener is designed in such a way that the helmet can be removed from the head easily after an accident. It is then impossible to fasten both helmet parts again via the frictional connection with the locking journals. Said helmet is not designed either to use the upper partial shells of the helmet as a separate mobile helmet.

The object of this invention is to design a safety helmet in such a way that an upper part can be worn as a separate helmet (semi-shell helmet) and that a protective lower part can be fixed to the upper part as required.

The object is satisfied in that the safety helmet consists of a semi-shell helmet and a lower helmet part enclosing the chin and the occiput/neck area, as an integral part, whereas the integral part can be connected in a detachable way to the semi-shell helmet.

Only the upper helmet part can hence be worn when riding uphill or with a less demanding ride. Said semi-shell helmet is equipped as a stand-alone helmet with a chin strap fastening and all that belongs to known helmets. The integral part can be transported separately in a rucksack or otherwise on the bike. The integral part can be fastened at all times to the semi-shell helmet for a more sporting application if needed.

According to an advantageous embodiment of the invention, the integral part is fixed on each side with a detachable connection on the semi-shell helmet. Additional detachable connections can be provided at other places as required and according to stability requirements.

It is particularly advantageously if the detachable connections are designed in a self-locking manner so that both helmet parts cannot be detached from one another in case of impact.

According to another advantageous embodiment of the invention, additional fastening means are provided between semi-shell helmet and integral part, as well as detachable connections. These means contribute to the stabilisation and safety of the connection between both helmet parts.

The detachable connections are more advantageously designed in such a way that they lock with the integral part when joining together the semi-shell helmet in a self-locking manner and with an interlocking or formlocking fit. It should then be easy to loosen and to assemble manually and without the use of a tool (screwdriver, coins or similar) and preferably in a single operation.

Figure 2:
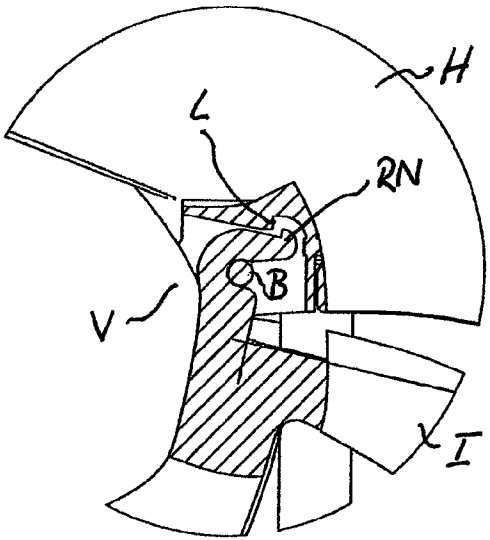
Figure 4:
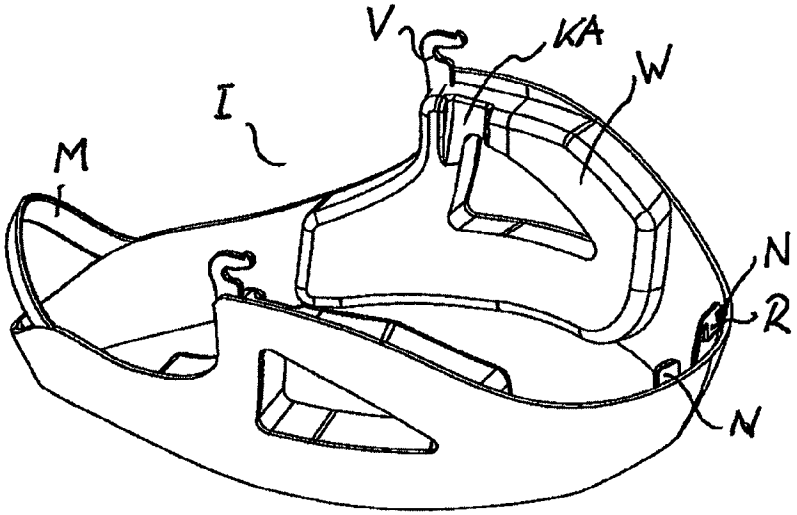
Figure 3:
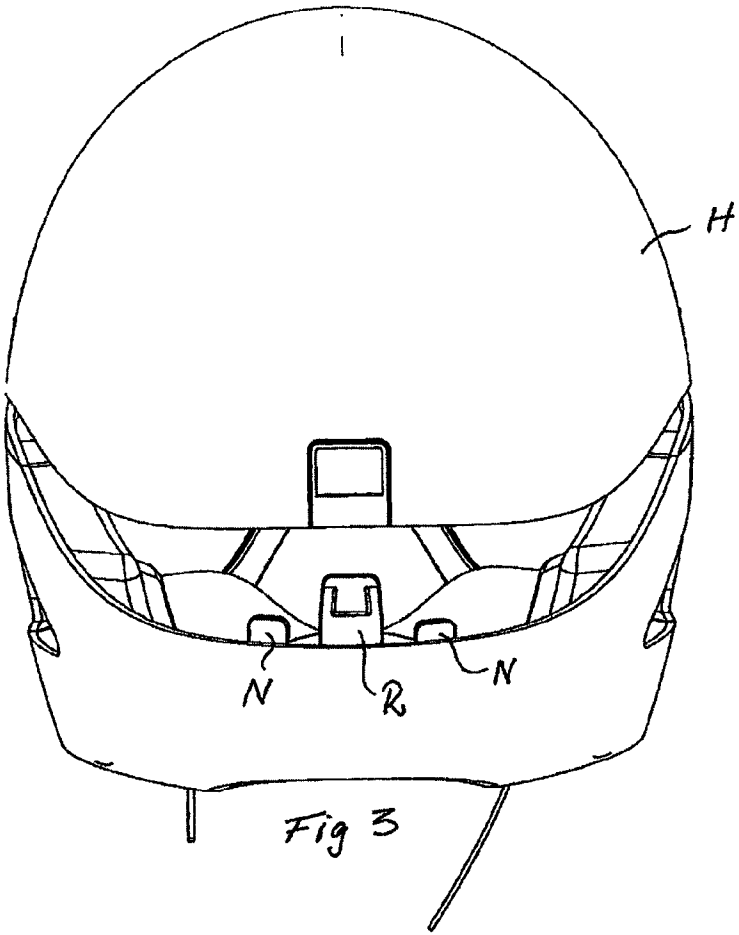
Figure 5:
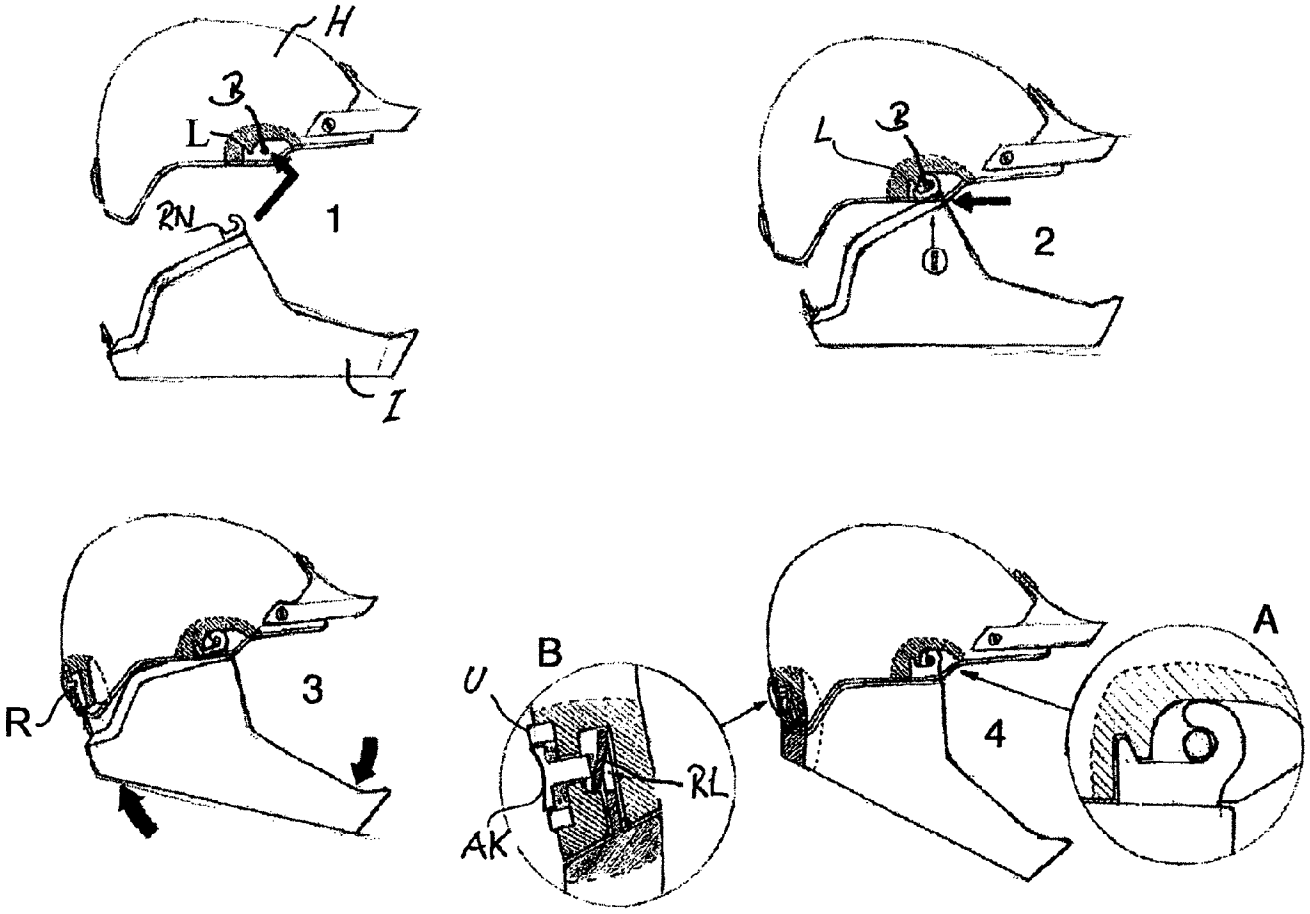

An example of an embodiment of the invention is represented in the drawings. Wherein FIG. 1 shows a safety helmet according to the invention FIG. 2 shows a detachable lateral connection (V) in a self-locking manner FIG. 3 shows a view of the safety helmet from the rear FIG. 4 shows a perspective view of the integral part I FIG. 5 shows a flowchart for fixing the integral part I to the semi-shell helmet H FIG. 1 shows a safety helmet according to the invention which consists of a semi-shell helmet H as well as an integral part I. The semi-shell helmet H can be connected in a detachable way to the integral part I via the self-locking connection V as well as via the self-locking connection R. The semi-shell helmet H includes a chin strap K with which it can also be fastened to the head without the integral part I. The integral part I moreover includes a mouth yoke M as an additional protection for the area around the mouth and the teeth, which is arranged above the chin protection S. The mouth yoke M can be designed flexibly so that it can be bent out for instance for setting a drinking bottle.

FIG. 2 shows an enlarged cutout of the detachable, self-locking lateral connection V. The hook-shaped connecting part V, mounted on the integral part I (only illustrated as cut-outs here) meshes into a bolt B and is pressed with its latching lug RN against the counterbearing L, when the integral part I is also connected in the rear area to the semi-shell helmet H. It can be seen that this connection V is self-locking, if a force acts upon the integral part I from the rear or from the front.

As can be seen on FIG. 1, a further snap-lock connection R is provided between the semi-shell helmet H and the integral part I in the rear area of the safety helmet. As can be seen in FIG. 3, fastening means N are provided symmetrically to that snap-lock connection R for increased stabilisation of the connection between the integral part I and the semi-shell helmet H.

FIG. 4 shows a perspective view of the integral part I. To avoid any repetitions, already known and described reference signs will not be further discussed. Cheek pads W can be seen in this representation of the integral part I. These cheek pads W are needed for a solid and secure position of the safety helmet. Recesses KA are provided in the cheek pads for the chin strap K. These recesses KA fasten the integral part I additionally and thereby contribute to a secure hold of the whole safety helmet. It goes without saying that the man skilled in the art can also apply additional and more costly measures than plain recesses KA in the cheek pads W so as to fasten the chin strap more securely with the integral part I. The integral part I, realised as a single piece in the exemplary embodiment, could also consist of two parts and in this form of embodiment could also be assembled with detachable connections.

FIG. 5 shows a flowchart for fixing the integral part I to the semi-shell helmet H. The self-locking connections V are illustrated here slightly modified in comparison to FIG. 2. In phase 1, the detachable self-locking connections V are first of all suspended into the bolts B (see arrow). In phase 2, the integral part I is then rotated around the bolts B, so that respectively the latching lug RN meshes into the counterbearing L. The illustration according to step 3 clearly shows how the locking latch mounted in the rear section of the safety helmet, of the rear detachable connection R is pressed into the corresponding counterbearing. The locking latch RL is resilient and hence snaps into the corresponding counterbearing. The click hence triggered can then be designed technically in such a way that it can be perceived distinctly and the user is then alerted that the integral part I is locked securely to the helmet. But a mechanical signalling can be provided for obtaining a secure locking. An unlocking knob AK is provided in the cut-out B of the process phase 4. It is designed in such a way that when released it lies inside its enclosure U. This can be obtained for instance with a spring which presses the unlocking knob AK inwardly. When locked, the larger elastic force of the locking latch RL presses the unlocking knob AK outwardly so that its rim closes up with the rim of the enclosure U. A further possible alarm device could be provided by a colour signal. The elastic force of the locking latch could move a colour disk or similar so that for instance the colour red could be seen, in a sight window to be provided, when released and the colour green when locked. In the present example, the inner rim of the enclosure U could include a signal colour which would be visible when pressed in and would be covered by the unlocking knob AK when locked. Embodiments of such signalling can of course also be provided in any combination.

It can be seen that the measures described enable to obtain a positive locking of the integral part I with the semi-shell helmet H, whereas the self-locking connections V are locked shut when the rear detachable connection R is blocked as intended. To do so, the user simply needs to operate a detachable connection (here the connection R) to make sure that the integral part I is locked as appropriate with the semi-shell helmet H.

The invention is not limited to bicycle helmets but can also be used with motorbike helmets or other safety helmets.

The invention claimed is:

1. A safety helmet, in particular for cyclists, the safety helmet comprising:

a self-contained portable semi shell helmet; and an integral part enclosing the chin and the occiput/neck area;

wherein the integral part is connected in a detachable way to the semi-shell helmet via at least one detachable connection between the integral part and the semi-shell helmet so that the at least one detachable connection can be detached and the semi-shell helmet can be worn by a user without the integral part, and the semi-shell helmet can subsequently be reconnected to the integral part via the at least one detachable connection.

2. The safety helmet according to claim 1, wherein the at least one detachable connection comprises a first detachable connection on a first side of the integral part or the semi-shell helmet and a second detachable connection on a second side of the integral part or the semi-shell helmet.

3. The safety helmet according to claim 2, wherein at least one of the first and second detachable connections is designed to be self-locking.

4. The safety helmet according to claim 2, wherein the at least one detachable connection further comprises an additional fastener between the semi-shell helmet and the integral part.

5. The safety helmet according to claim 1, wherein the at least one detachable connection is designed in such a way that when joining together the semi-shell helmet and the integral part the at least one detachable connection is locked in a self-locking manner and with an interlocking fit.

6. The safety helmet according to claim 1, wherein the at least one detachable connection is designed in such a way that the semi-shell helmet is locked automatically with the integral part in an assembled state.

7. The safety helmet according to claim 1, wherein the at least one detachable connection is designed in such a way that the semi-shell helmet and the integral part can be detached and fixed manually.

* * * * *